US011631361B2

(12) United States Patent
Lee

(10) Patent No.: US 11,631,361 B2
(45) Date of Patent: Apr. 18, 2023

(54) DISPLAY APPARATUS AND METHOD OF DRYING THE SAME

(71) Applicant: Samsung Display Co., Ltd., Yongin-Si (KR)

(72) Inventor: Sukhun Lee, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/412,804

(22) Filed: Aug. 26, 2021

(65) Prior Publication Data

US 2022/0068189 A1 Mar. 3, 2022

(30) Foreign Application Priority Data

Aug. 28, 2020 (KR) ..... 10-2020-0109286

(51) Int. Cl.
*G09G 3/20* (2006.01)

(52) U.S. Cl.
CPC ... *G09G 3/2092* (2013.01); *G09G 2300/0465* (2013.01); *G09G 2310/027* (2013.01); *G09G 2310/0275* (2013.01)

(58) Field of Classification Search
CPC ..... G09G 3/2092; G09G 2300/0465; G09G 2310/027; G09G 2310/0275; G09G 2310/0232; G09G 2320/0271; G09G 2320/0686; G09G 2340/0407; G09G 3/20; G09G 3/3275; G09G 3/3266; G09G 2320/0233; G09F 9/30
See application file for complete search history.

(56) References Cited

U.S. PATENT DOCUMENTS

| | | | | |
|---|---|---|---|---|
| 9,535,655 | B2 * | 1/2017 | Zhang | G06F 3/165 |
| 10,068,540 | B2 * | 9/2018 | Park | G09G 3/3607 |
| 10,395,605 | B2 * | 8/2019 | Son | G09G 3/3426 |
| 10,466,841 | B2 * | 11/2019 | Park | G06F 3/0443 |
| 10,706,775 | B2 * | 7/2020 | Shin | G09G 3/003 |
| 10,866,616 | B2 * | 12/2020 | Seo | G06F 1/1613 |
| 10,877,520 | B2 * | 12/2020 | Kim | G06F 1/1647 |
| 11,138,951 | B2 * | 10/2021 | Ko | G09G 3/03 |
| 11,216,106 | B2 * | 1/2022 | Lindblad | G09F 9/301 |
| 2010/0064536 | A1 * | 3/2010 | Caskey | G06F 1/1694 33/303 |
| 2010/0085274 | A1 * | 4/2010 | Kilpatrick, II | G06F 1/1641 345/1.3 |

(Continued)

FOREIGN PATENT DOCUMENTS

KR 101942950 B1 1/2019

*Primary Examiner* — Jose R Soto Lopez
(74) *Attorney, Agent, or Firm* — Cantor Colburn LLP

(57) ABSTRACT

A display apparatus includes a display panel, a gate driver, a data driver and a driving controller. The display panel includes an edge area having a rounded shape in a first state and having a flat shape in a second state. The gate driver applies a gate signal to a gate line of the display panel, the data driver applies a data voltage to a data line of the display panel, and the driving controller processes input image data according to the first state and the second state. The display panel includes a first display area having a first pixel density and a second display area having a second pixel density less than the first pixel density. The second display area corresponds to the edge area of the display panel.

20 Claims, 8 Drawing Sheets

(56) References Cited

U.S. PATENT DOCUMENTS

2010/0085382 A1* 4/2010 Lundqvist ..... G06F 3/1438 345/659
2010/0216514 A1* 8/2010 Smoyer ..... H04M 1/0283 455/566
2013/0100053 A1* 4/2013 Kang ..... G06F 3/0445 345/173
2013/0215041 A1* 8/2013 Kim ..... G06F 1/1694 345/173
2013/0215088 A1* 8/2013 Son ..... G06F 3/04897 345/204
2013/0329422 A1* 12/2013 Park ..... F21V 23/0471 362/233
2014/0306985 A1* 10/2014 Jeong ..... G09G 3/035 345/600
2015/0138041 A1* 5/2015 Hirakata ..... G06F 3/1446 345/1.3
2015/0179139 A1* 6/2015 Watanabe ..... G09G 3/20 345/592
2015/0301672 A1* 10/2015 Kim ..... G09G 3/035 345/156
2015/0348453 A1* 12/2015 Jin ..... G09F 9/301 345/173
2016/0117994 A1* 4/2016 Lee ..... H04N 5/57 345/694
2016/0127674 A1* 5/2016 Kim ..... H04N 21/42204 348/739
2016/0148554 A1* 5/2016 Lim ..... G09G 3/20 345/694
2016/0205391 A1* 7/2016 Kim ..... G09G 3/3225 348/51
2016/0210901 A1* 7/2016 Cha ..... G09G 3/3225
2016/0231850 A1* 8/2016 Choi ..... G06F 1/1694
2017/0206835 A1* 7/2017 Hirakata ..... H01L 27/3276
2017/0206859 A1* 7/2017 Jun ..... G09G 3/006
2018/0018929 A1* 1/2018 Xun ..... G06F 1/1626
2018/0074675 A1* 3/2018 Soh ..... G06F 3/043
2018/0113241 A1* 4/2018 Powell ..... G02B 5/32
2018/0114474 A1* 4/2018 Powell ..... G09G 3/02
2018/0374426 A1* 12/2018 Chen ..... G09G 3/3225
2019/0051230 A1* 2/2019 Jeon ..... G09G 3/3233
2020/0081492 A1* 3/2020 Wang ..... H04N 9/3141
2020/0296843 A1* 9/2020 Gao ..... G09G 3/03
2021/0141587 A1* 5/2021 Cho ..... G02F 1/133305
2021/0191478 A1* 6/2021 Mehandjiysky ..... G06F 1/1601
2021/0210010 A1* 7/2021 Gao ..... G09G 3/3225

* cited by examiner

DISPLAY APPARATUS AND METHOD OF DRYING THE SAME

This application claims priority to Korean Patent Application No. 10-2020-0109286, filed on Aug. 28, 2020, and all the benefits accruing therefrom under 35 U.S.C. § 119, the content of which in its entirety is herein incorporated by reference.

BACKGROUND

1. Field

Embodiments of the invention relate to a display apparatus and a method of driving the display apparatus. More particularly, embodiments of the invention relate to a display apparatus in which an edge area of a display panel is selectively in a round state or a flat state and a method of driving the display apparatus.

2. Description of the Related Art

A small-sized display apparatus such as a smartphone in which an edge area of a display panel is typically formed to be rounded has been introduced to enhance design, to enhance grip and to apply various applications.

In addition, a large-sized curved display apparatus, in which an edge area of a display panel is formed to be rounded, has been introduced to increase a user immersion.

SUMMARY

Public preference to a display apparatus with a round edge may tend to be divided, so that a user may not be sufficiently satisfied with the round edge.

Embodiments of the invention provide a display apparatus capable of selectively implementing an edge area of a display panel in a round state or a flat state.

Embodiments of the invention also provide a method of driving the display apparatus.

In an embodiment of a display apparatus according to the invention, the display apparatus includes a display panel, a gate driver, a data driver and a driving controller. In such an embodiment, the display panel includes an edge area having a rounded shape in a first state and having a flat shape in a second state. In such an embodiment, the gate driver applies a gate signal to a gate line of the display panel, the data driver applies a data voltage to a data line of the display panel, and the driving controller processes input image data according to the first state and the second state. In such an embodiment, the display panel includes a first display area having a first pixel density and a second display area having a second pixel density less than the first pixel density, and the second display area corresponds to the edge area of the display panel.

In an embodiment, the display apparatus may further include a hinge disposed corresponding to the edge area of the display panel. In such an embodiment, the hinge may convert a shape of the edge area to the rounded shape or the flat shape.

In an embodiment, the first display area may be active and the second display area may be inactive in the first state.

In an embodiment, the first display area may be active and the second display area may be active in the second state.

In an embodiment, the driving controller in the first state may generate a data signal based on the input image data corresponding to the first display area and output the data signal to the data driver. In such an embodiment, the driving controller in the second state may upscale the input image data corresponding to the first display area to match the first display area and the second display area to generate an upscaled data signal and output the upscaled data signal to the data driver.

In an embodiment, the driving controller in the second state may generate a data signal based on the input image data corresponding to the first display area and the second display area and t output the data signal to the data driver. In such an embodiment, the driving controller in the first state may trim the input image data corresponding to the first display area and the second display area to match the first display area to generate a trimmed data signal and output the trimmed data signal to the data driver.

In an embodiment, the driving controller may include a luminance compensator which compensates a first luminance of the first display area and a second luminance of the second display area in a way such that the first luminance of the first display area is equal to the second luminance of the second display area for an image data having a same grayscale value in the second state.

In an embodiment, the display panel may include a first edge area disposed in a left side of the display panel and a second edge area disposed in a right side of the display panel. In such an embodiment, a display area corresponding to the first edge area may be the second display area, a display area corresponding to the second edge area may be a third display area, and the first display area may be disposed between the second display area and the third display area. In such an embodiment, t luminance of the second display area may be compensated based on an average luminance of an area of the first display area adjacent to the second display area, and a luminance of the third display area may be compensated based on an average luminance of an area of the first display area adjacent to the third display area.

In an embodiment, the display panel may include a first edge area disposed in a left side of the display panel, a second edge area disposed in a right side of the display panel, a third edge area disposed in an upper side of the display panel and a fourth edge area disposed in a lower side of the display panel. In such an embodiment, a display area corresponding to the first edge area may be the second display area, a display area corresponding to the second edge area may be a third display area, a display area corresponding to the third edge area may be a fourth display area, a display area corresponding to the fourth edge area may be a fifth display area, and the first display area may be disposed between the second display area, the third display area, the fourth display area and the fifth display area. In such an embodiment, a luminance of the second display area may be compensated based on an average luminance of an area of the first display area adjacent to the second display area, a luminance of the third display area may be compensated based on an average luminance of an area of the first display area adjacent to the third display area, a luminance of the fourth display area may be compensated based on an average luminance of an area of the first display area adjacent to the fourth display area, and a luminance of the fifth display area may be compensated based on an average luminance of an area of the first display area adjacent to the fifth display area.

In an embodiment, the display panel may include a first edge area disposed in a left side of the display panel, a second edge area disposed in a right side of the display panel, a third edge area disposed in an upper side of the display panel, and a fourth edge area disposed in a lower side of the display panel. In such an embodiment, a display area corresponding to the first edge area may be the second display area, a display area corresponding to the second edge area may be a third display area, a display area corresponding to the third edge area may be a fourth display area, a display area corresponding to the fourth edge area may be a fifth display area, and the first display area may be disposed between the second display area, the third display area, the fourth display area and the fifth display area. In such an embodiment, a display area corresponding to a first corner where the first edge area and the second edge area meet may be a first corner display area, a display area corresponding to a second corner where the second edge area and the third edge area meet may be a second corner display area, a display area corresponding to a third corner where the first edge area and the fourth edge area meet may be a third corner display area, and a display area corresponding to a fourth corner where the second edge area and the fourth edge area meet may be a fourth corner display area. In such an embodiment, a luminance of the second display area may be compensated based on an average luminance of an area of the first display area adjacent to the second display area, a luminance of the third display area may be compensated based on an average luminance of an area of the first display area adjacent to the third display area, a luminance of the fourth display area may be compensated based on an average luminance of an area of the first display area adjacent to the fourth display area, and a luminance of the fifth display area may be compensated based on an average luminance of an area of the first display area adjacent to the fifth display area. In such an embodiment, a luminance of the first corner display area may be compensated by interpolating a compensation value of the second display area and a compensation value of the fourth display area, a luminance of the second corner display area may be compensated by interpolating a compensation value of the third display area and the compensation value of the fourth display area, a luminance of the third corner display area may be compensated by interpolating the compensation value of the second display area and a compensation value of the fifth display area, and a luminance of the fourth corner display area may be compensated by interpolating the compensation value of the third display area and the compensation value of the fifth display area.

In an embodiment, the driving controller may include a color coordinate compensator which compensates a first color coordinate of the first display area and a second color coordinate of the second display area in a way such that the first color coordinate of the first display area is equal to the first color coordinate of the second display area for an image data having a same grayscale value in the second state.

In an embodiment, the display panel may include a first edge area disposed in a left side of the display panel and a second edge area disposed in a right side of the display panel. In such an embodiment, a display area corresponding to the first edge area may be the second display area, a display area corresponding to the second edge area may be a third display area, and the first display area may be disposed between the second display area and the third display area. In such an embodiment, a color coordinate of the second display area may be compensated based on an average color coordinate of an area of the first display area adjacent to the second display area, and a color coordinate of the third display area may be compensated based on an average color coordinate of an area of the first display area adjacent to the third display area.

In an embodiment, the display apparatus may further include an angle sensor which senses an angle of the edge area of the display panel. In such an embodiment, the driving controller may be which automatically controls an active state and an inactive state of the second display area based on the angle of the edge area.

In an embodiment, the edge area of the display panel may have a rounded shape in a third state. In such an embodiment, a display surface of the display panel may have a convexly rounded shape in the first state, and the display surface of the display panel may have a concavely rounded shape in the third state.

In an embodiment, the first display area may be active and the second display area may be inactive in the first state. In such an embodiment, the first display area may be active and the second display area may be active in the second state. In such an embodiment, the first display area may be active and the second display area may be active in the third state.

In an embodiment of a method of driving a display apparatus according to the invention, the method includes determining a state of the display apparatus, where the states of the display apparatus includes a first state in which an edge area of a display panel of the display apparatus has a rounded shape and a second state in which the edge area of the display panel has a flat shape, processing input image data according to the first state and the second state, applying a gate signal to a gate line of the display panel and applying a data voltage to a data line of the display panel. In such an embodiment, the display panel may include a first display area having a first pixel density and a second display area having a second pixel density less than the first pixel density, and the second display area may correspond to the edge area of the display panel.

In an embodiment, the first display area may be active and the second display area may be inactive in the first state. In such an embodiment, the first display area may be active and the second display area may be active in the second state.

In an embodiment, the processing input image data may include generating a data signal in the first state based on the input image data corresponding to the first display area, and generating an upscaled data signal in the second state by upscaling the input image data corresponding to the first display area to match the first display area and the second display area.

In an embodiment, the processing input image data may include generating a data signal in the second state based on the input image data corresponding to the first display area and the second display area, and generating a trimmed data signal in the first state by trimming the input image data corresponding to the first display area and the second display area to match the first display area and outputting the trimmed data signal to a data driver of the display apparatus in the first state.

According to embodiments of the display apparatus and the method of driving the display apparatus, the edge area of the display panel may be selectively implemented in the round state or the flat state. In such embodiments, the edge area of the display panel includes pixels so that an image may be displayed on an entire area of the display panel when the edge area of the display panel is in the flat state.

In such embodiments, when the edge area of the display panel is in the flat state, a difference between a luminance of an image displayed on a first display area corresponding to a central area of the display panel and a luminance of an image displayed on a second display area corresponding to the edge area and a difference between a color coordinate of the image displayed on the first display area and a color coordinate of the image displayed on the second display area may be compensated so that the display quality of the display panel may be enhanced.

BRIEF DESCRIPTION OF THE DRAWINGS

The above and other features of the invention will become more apparent by describing in detailed embodiments thereof with reference to the accompanying drawings, in which.

DETAILED DESCRIPTION

Figure 1:
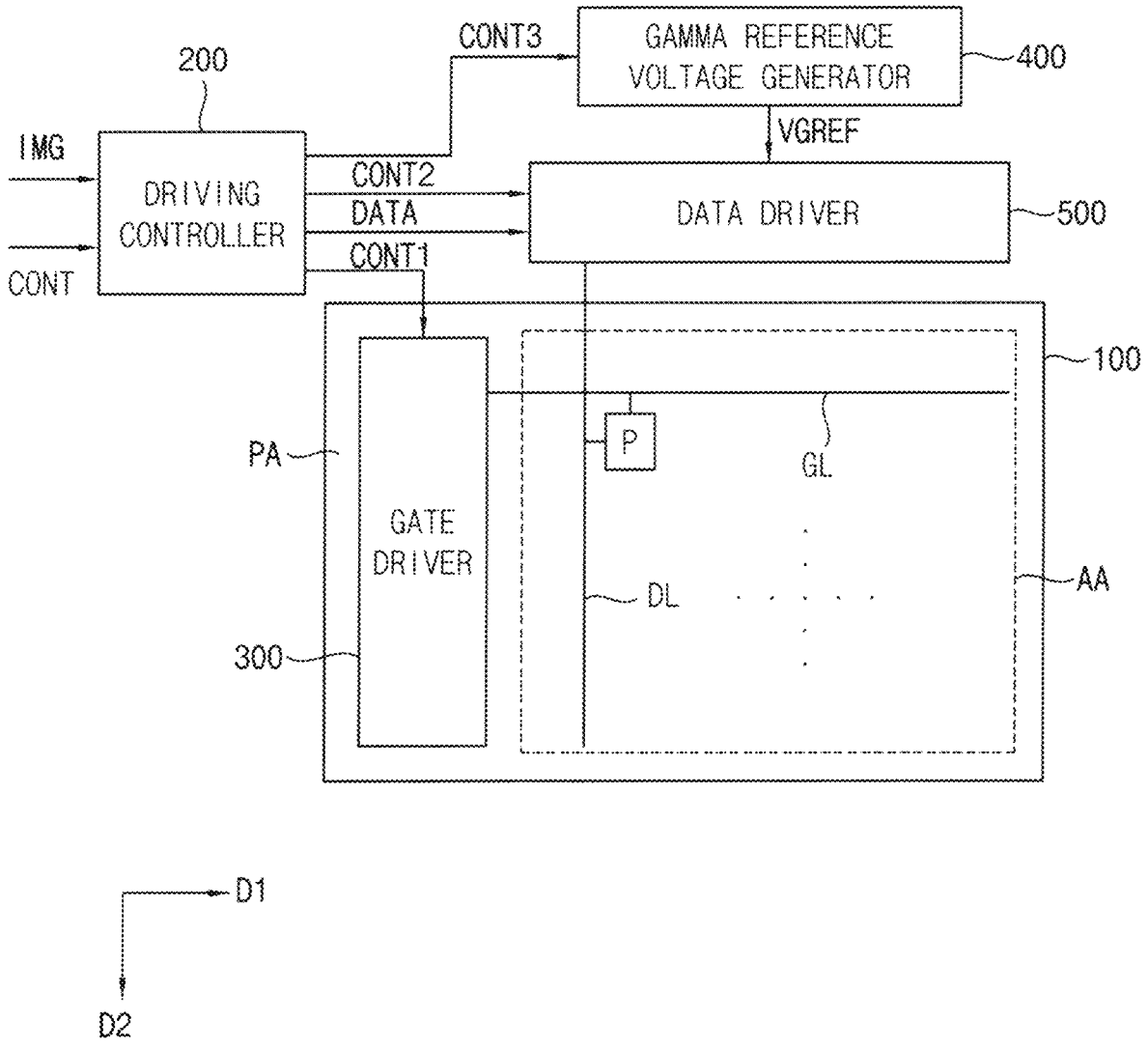
FIG. 1 is a block diagram illustrating a display apparatus according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or" As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram illustrating a display apparatus according to an embodiment of the invention.

Referring to FIG. 1, an embodiment of the display apparatus includes a display panel 100 and a display panel driver. The display panel driver includes a driving controller 200, a gate driver 300, a gamma reference voltage generator 400 and a data driver 500.

In one embodiment, for example, the driving controller 200 and the data driver 500 may be integrally formed as a single unitary unit. In one embodiment, for example, the driving controller 200, the gamma reference voltage generator 400 and the data driver 500 may be integrally formed as a single unitary unit. A driving module including at least the driving controller 200 and the data driver 500 which are integrally formed may be referred to as a timing controller embedded data driver ("TED").

The display panel 100 may have a pixel region AA where pixels are disposed and a circuit region PA adjacent to the display region AA. A driving circuit may be disposed in the circuit region PA. In an embodiment, pixels may also be disposed in the circuit region PA. A density of the pixels of the pixel region AA may be different from a density of the pixels of the circuit region PA.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction Dl.

The driving controller 200 receives input image data IMG and an input control signal CONT from an external apparatus. In an embodiment, the input image data IMG may include red image data, green image data and blue image data. The input image data IMG may further include white image data. In an alternative embodiment, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. In one embodiment, for example, the gate driver 300 may sequentially output the gate signals to the gate lines GL.

In an embodiment, the gate driver 300 may be integrated on the circuit region PA of the display panel 100. In such an embodiment, as described above, the pixels may also be disposed in the circuit region PA.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

In one embodiment, for example, the display apparatus may be a smartphone or a tablet computer which is portable by a user. Alternatively, the display apparatus may be a monitor for a computer or a television which is not portable by the user.

Figure 2:
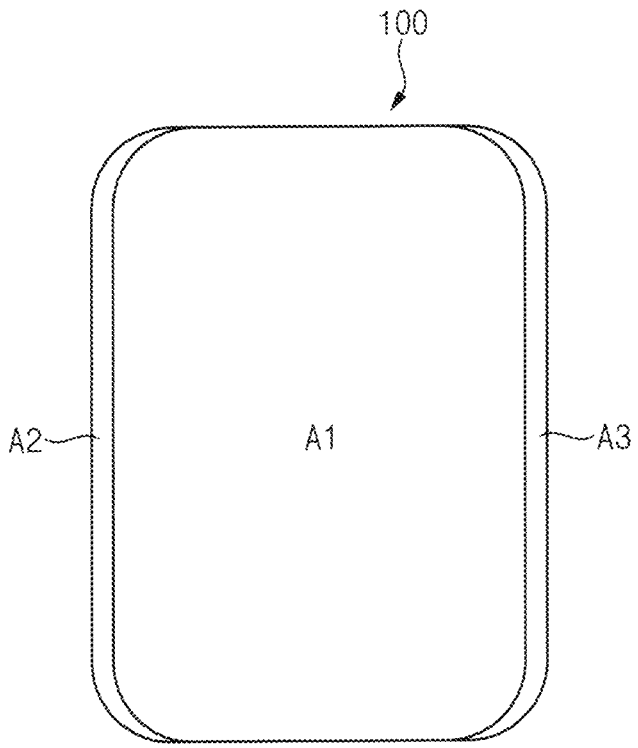
FIG. 2 is a plan view diagram illustrating a display panel of FIG. 1.
Figure 3:
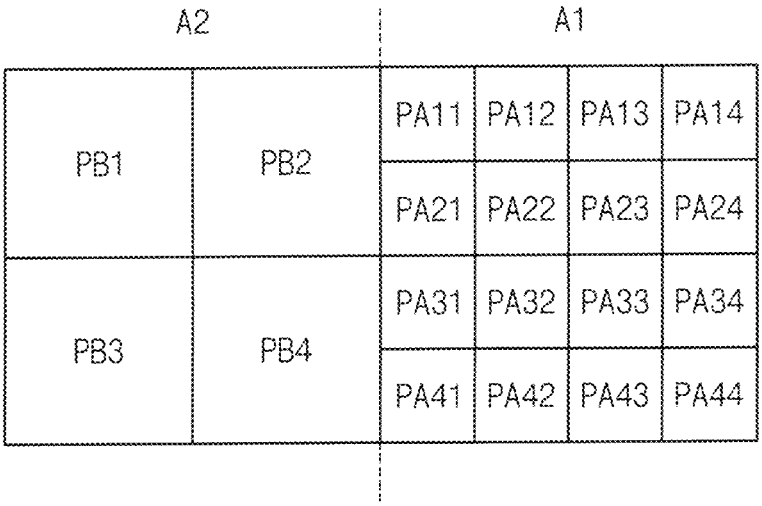
FIG. 3 is a conceptual diagram illustrating a first display area and a second display area of FIG. 2.
Figure 4:
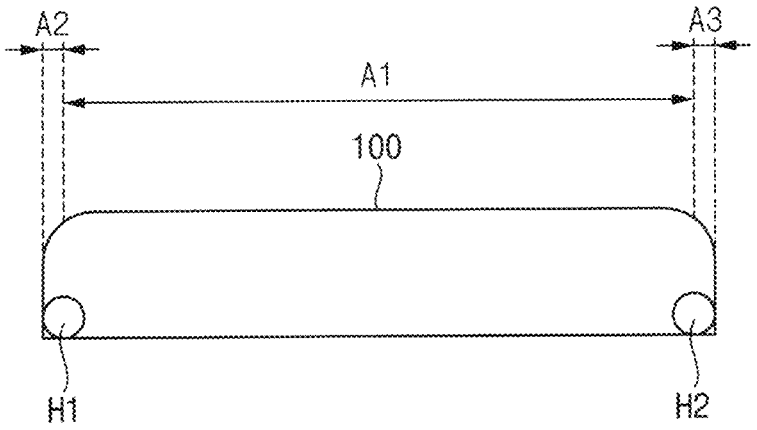
FIG. 4 is a cross-sectional view illustrating the display panel of FIG. 1 in a first state.
Figure 5:
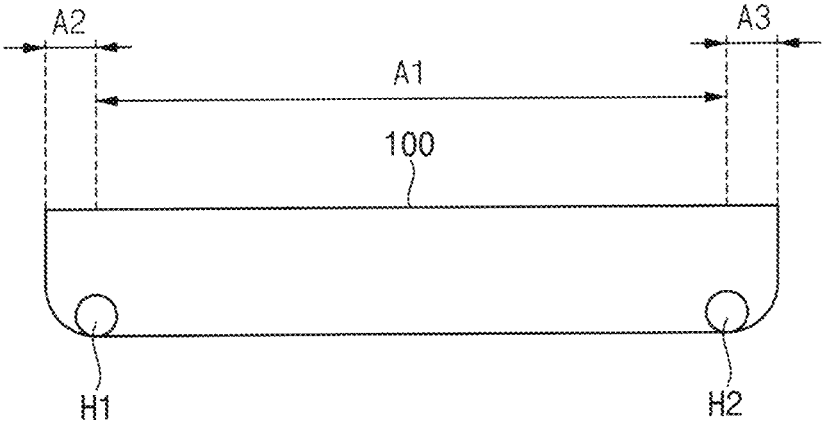
FIG. 5 is a cross-sectional view illustrating the display panel of FIG. 1 in a second state.

FIG. 2 is a plan view diagram illustrating the display panel 100 of FIG. 1. FIG. 3 is a conceptual diagram illustrating a first display area A1 and a second display area A2 of FIG. 2. FIG. 4 is a cross-sectional view illustrating the display panel 100 of FIG. 1 in a first state. FIG. 5 is a cross-sectional view illustrating the display panel 100 of FIG. 1 in a second state.

Referring to FIGS. 1 to 5, in an embodiment, at least one edge area of the display panel 100 may have a rounded or curved shape in the first state and at least one edge area of the display panel 100 may have a flat shape in the second state. In one embodiment, for example, a central area of the display panel 100 may be flat in both of the first state and the second state.

In one embodiment, for example, a left edge area and a right edge area of the display panel 100 may be round or curved in the first state and the left edge area and the right edge area of the display panel 100 may be flat in the second state. In one embodiment, for example, both the left edge area and the right edge area have the rounded shape or both the left edge and the right edge have the flat shape, as shown in FIGS. 4 and 5, but not being limited thereto. In an alternative embodiment, each of the left edge area and the right edge area may independently have the rounded shape or the flat shape.

The display panel 100 may include a first display area A1 having a first pixel density and a second display area (e.g. A2) having a second pixel density less than the first pixel density. The second display area (e.g. A2) may correspond to the edge area of the display panel 100. The first display area A1 may be an area between the left edge area and the right edge area.

In an embodiment, as shown in FIG. 2, the display panel 100 may include a first edge area disposed in a left side of the display panel 100 and a second edge area disposed in a right side of the display panel 100. A display area corresponding to the first edge area may be the second display area A2 and a display area corresponding to the second edge area may be the third display area A3. The first display area A1 may be disposed between the second display area A2 and the third display area A3.

In an embodiment, the second display area A2 has the second pixel density less than the first pixel density of the first display area A1 as shown in in FIG. 3. Here, "pixel density" may be defined as a number of pixels (e.g., PA11 to PA44 in A1 or PB1 to PB4 in A2) per unit area. In such an embodiment, the third display area A3 may also have the second pixel density less than the first pixel density of the first display area A1.

In an embodiment, as shown in FIG. 4, the second display area A2 and the third display area A3 may not exactly coincide with the rounded areas of the edge areas. In an embodiment, as shown in FIG. 4, the first display area A1 may correspond to the central area of the display panel 100 having a flat shape regardless of the first state and the second state. The first display area A1 may further include a rounded portion of the left edge area adjacent to the central area and a rounded portion of the right edge area adjacent to the central area.

A boundary between the first display area A1 and the second display area A2 may not be determined by a boundary between the rounded portion and the flat portion but determined by the pixel density of the first display area A1 and the pixel density of the second display area A2.

The display apparatus may further include a hinge H1 and H2 disposed corresponding to the edge area of the display panel 100. The hinge H1 and H2 may convert the shape of the edge area to be rounded or to be flat. In an embodiment, the display apparatus may include a first hinge H1 corresponding to the left edge area of the display panel 100 and a second hinge H2 corresponding to the right edge area of the display panel 100.

In an embodiment, a user may push a lower edge portion of the display apparatus toward a display surface of the display panel 100 such that the edge area of the display panel 100 may become flat. In such an embodiment, the user may push an edge portion of the display surface of the display panel 100 toward a lower surface of the display apparatus such that the edge area of the display panel 100 may become rounded or curved.

In the first state, the first display area A1 may be active and the second display area A2 and the third display area A3 may be inactive. In the second state, the first display area A1 may be active and the second display area A2 and the third display area A3 may also be active.

In the first state in which the edge area of the display panel 100 is rounded or curved, the display apparatus may be operated in an edge round mode. In the second state in which the edge area of the display panel 100 is flat, the display apparatus may be operated in an edge flat mode.

When the display apparatus is in the edge round mode, only the first display area A1 may display the image. When the display apparatus is in the edge flat mode, all of the first display area A1, the second display area A2 and the third display area A3 may display the image.

Figure 6:
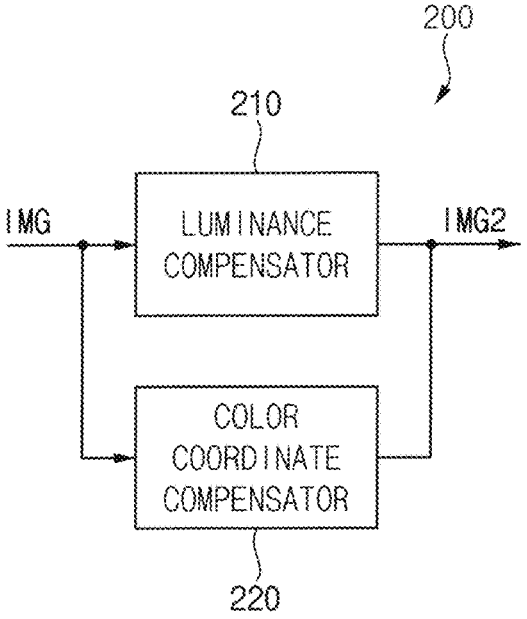
FIG. 6 is a block diagram illustrating a driving controller of FIG. 1.
Figure 7:
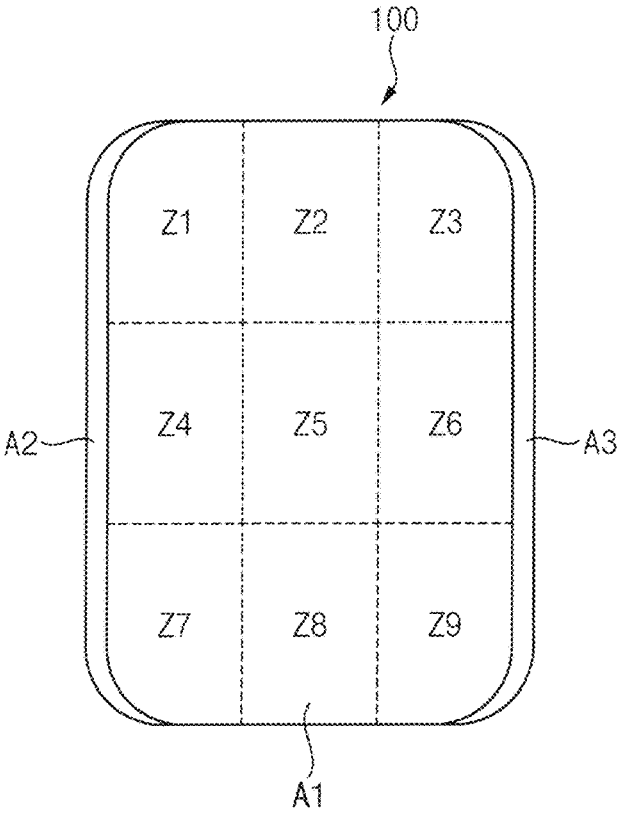
FIG. 7 is a conceptual diagram illustrating an operation of the driving controller of FIG. 6.

FIG. 6 is a block diagram illustrating the driving controller 200 of FIG. 1. FIG. 7 is a conceptual diagram illustrating an operation of the driving controller 200 of FIG. 6.

Referring to FIGS. 1 to 7, an embodiment of the driving controller may process the input image data IMG according to the first state and the second state.

In an embodiment, the driving controller 200 may receive the input image data IMG corresponding to the first display area A1. In such an embodiment, the driving controller 200 in the first state may generate the data signal DATA based on the input image data IMG corresponding to the first display area A1 and may output the data signal DATA to the data driver 500. In such an embodiment, the driving controller 200 in the second state may upscale the input image data IMG corresponding to the first display area A1 to match the first display area A1, the second display area A2 and the third display area A3 to generate an upscaled data signal and may output the upscaled data signal DATA to the data driver 500.

In an alternative embodiment, the driving controller 200 may receive the input image data IMG corresponding to the first display area A1, the second display area A2 and the third display area A3. In such an embodiment, the driving controller 200 in the second state may generate the data signal DATA based on the input image data IMG corresponding to the first display area A1, the second display area A2 and the third display area A3 and may output the data signal DATA to the data driver 500. In such an embodiment, the driving controller 200 in the first state may trim the input image data IMG corresponding to the first display area A1, the second display area A2 and the third display area A3 to match the first display area A1 to generate a trimmed data signal and may output the trimmed data signal DATA to the data driver 500. The driving controller 200 may trim the second display area A2 and the third display area A3 of the input image data IMG to match the first display area A1.

In an embodiment, the driving controller 200 may include a luminance compensator 210 for compensating a first luminance of the first display area A1 and a second luminance of the second display area A2 such that the first luminance of the first display area A1 is equal to the second luminance of the second display area A2 for an image data having a same grayscale value in the second state. An input of the luminance compensator 210 may be the input image data IMG and an output of the luminance compensator 210 may be compensated input image data IMG2.

In an embodiment where the display area corresponding to the first edge area is the second display area A2, the display area corresponding to the second edge area is the third display area A3 and the first display area A1 is disposed between the second display area A2 and the third display area A3, the luminance of the second display area A2 may be compensated based on an average luminance of an area of the first display area A1 adjacent to the second display area A2 and the luminance of the third display area A3 may be compensated based on an average luminance of an area of the first display area A1 adjacent to the third display area A3.

In one embodiment, for example, the luminance of the second display area A2 may be compensated based on an average luminance of Z1, Z4 and Z7 of FIG. 7 which are the areas of the first display area A1 adjacent to the second display area A2. In one embodiment, for example, the luminance of the third display area A3 may be compensated based on an average luminance of Z3, Z6 and Z9 of FIG. 7 which are the areas of the first display area A1 adjacent to the third display area A3.

The driving controller 200 may further include a color coordinate compensator 220 compensating a first color coordinate of the first display area A1 and a second color coordinate of the second display area A2 such that the first color coordinate of the first display area A1 is equal to the first color coordinate of the second display area A2 for an image data having the same grayscale value in the second state. An input of the color coordinate compensator 220 may be the input image data IMG and an output of the color coordinate compensator 220 may be the compensated input image data IMG2.

In one embodiment, for example, where an entire area of the first display area A1 is divided into a plurality of areas Z1 to Z9, the color coordinate of the second display area A2 may be compensated based on an average color coordinate of areas Z1, Z4 and Z7 of FIG. 7 which are the areas of the first display area A1 adjacent to the second display area A2. In such an embodiment, the color coordinate of the third display area A3 may be compensated based on an average color coordinate of areas Z3, Z6 and Z9 of FIG. 7 which are the areas of the first display area A1 adjacent to the third display area A3.

According to an embodiment, the edge area of the display panel 100 may be selectively implemented in the round state or the flat state. The edge area of the display panel 100 includes pixels so that an image may be displayed on an entire area of the display panel 100 when the edge area of the display panel 100 has the flat state.

In such an embodiment, when the edge area of the display panel 100 is in the flat state, a difference between a luminance of an image displayed on the first display area A1 corresponding to the central area of the display panel 100 and luminances of images displayed on the second display area A2 and the third display area A3 corresponding to the edge areas and a difference between a color coordinate of the image displayed on the first display area A1 and color coordinates of the images displayed on the second display area A2 and the third display area A3 may be compensated such that the display quality of the display panel 100 may be enhanced.

Figure 8:
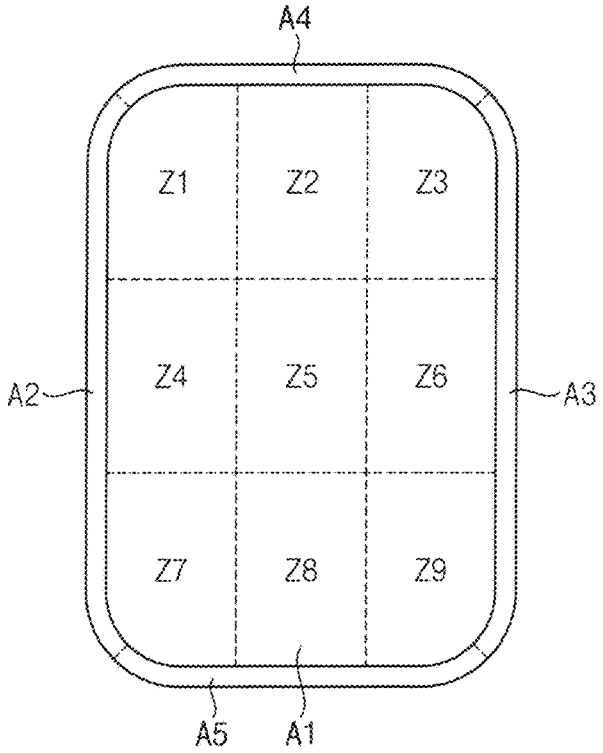
FIG. 8 is a conceptual diagram illustrating an operation of a driving controller of a display apparatus according to an alternative embodiment of the invention.

FIG. 8 is a conceptual diagram illustrating an operation of a driving controller of a display apparatus according to an alternative embodiment of the invention.

The embodiment of the display apparatus and the method of driving the display apparatus shown in FIG. 8 is substantially the same as the embodiments of the display apparatus and the method of driving the display apparatus described above referring to FIGS. 1 to 7 except that the edge areas of the display panel varying in state are disposed at an upper side, a lower side, a left side and a right side of the display panel. Thus, the same reference numerals will be used to refer to the same or like elements as those described above with reference to FIGS. 1 to 7, and any repetitive detailed description thereof will be omitted.

Referring to FIGS. 1, 3 to 6 and 8, an embodiment of the display apparatus includes a display panel 100 and a display panel driver. The display panel driver includes a driving controller 200, a gate driver 300, a gamma reference voltage generator 400 and a data driver 500.

At least one edge area of the display panel 100 may have a rounded shape in the first state and at least one edge area of the display panel 100 may have a flat shape in the second state. In one embodiment, for example, a central area of the display panel 100 may be flat in both of the first state and the second state.

In one embodiment, for example, a left edge area, a right edge area, an upper edge area and a lower edge area of the display panel 100 may be round in the first state and the left edge area, the right edge area, the upper edge area and the lower edge area of the display panel 100 may be flat in the second state. In one embodiment, for example, all of the left edge area, the right edge area, the upper edge area and the lower edge area have the rounded shape or all of the left edge area, the right edge area, the upper edge area and the lower edge area have the flat shape, but not being limited thereto. In an alternative embodiment, each of the left edge, the right edge area, the upper edge area and the lower edge area may independently have the rounded shape or the flat shape.

The display panel 100 may include a first display area A1 having a first pixel density and a second display area (e.g. A2) having a second pixel density less than the first pixel density. The second display area (e.g. A2) may correspond to the edge area of the display panel 100.

In an embodiment, the display panel 100 may include a first edge area disposed in a left side of the display panel 100, a second edge area disposed in a right side of the display panel 100, a third edge area disposed in an upper side of the display panel 100 and a fourth edge area disposed in a lower side of the display panel 100. A display area corresponding to the first edge area may be the second display area A2, a display area corresponding to the second edge area may be the third display area A3, a display area corresponding to the third edge area may be the fourth display area A4 and a display area corresponding to the fourth edge area may be the fifth display area A5. The first display area A1 may be disposed between the second display area A2, the third display area A3, the fourth display area A4 and the fifth display area A5.

In the first state, the first display area A1 may be active and the second to fifth display areas A2 to A5 may be inactive. In the second state, the first display area A1 may be active and the second to fifth display areas A2 to A5 may be active.

The driving controller may process the input image data IMG according to the first state and the second state.

The driving controller 200 may include a luminance compensator 210 for compensating a first luminance of the first display area A1 and a second luminance of the second display area A2 such that the first luminance of the first display area A1 is equal to the second luminance of the second display area A2 for an image data having a same grayscale value in the second state.

In one embodiment, for example, the luminance of the second display area A2 may be compensated based on an average luminance of the areas Z1, Z4 and Z7 of FIG. 8 which are the areas of the first display area A1 adjacent to the second display area A2. In one embodiment, for example, the luminance of the third display area A3 may be compensated based on an average luminance of areas Z3, Z6 and Z9 of FIG. 8 which are the areas of the first display area A1 adjacent to the third display area A3. In one embodiment, for example, the luminance of the fourth display area A4 may be compensated based on an average luminance of areas Z1, Z2 and Z3 of FIG. 8 which are the areas of the first display area A1 adjacent to the fourth display area A4. In one embodiment, for example, the luminance of the fifth display area A5 may be compensated based on an average luminance of areas Z7, Z8 and Z9 of FIG. 8 which are the areas of the first display area A1 adjacent to the fifth display area A5.

The driving controller 200 may further include a color coordinate compensator 220 for compensating a first color coordinate of the first display area A1 and a second color coordinate of the second display area A2 such that the first color coordinate of the first display area A1 is equal to the first color coordinate of the second display area A2 for an image data having a same grayscale value in the second state. The operation of the color coordinate compensator 220 may be similar to the operation of the luminance compensator 210 described above with reference to FIG. 6.

According to an embodiment, the edge area of the display panel 100 may be selectively implemented in the round state or the flat state. The edge area of the display panel 100 includes pixels so that an image may be displayed on an entire area of the display panel 100 when the edge area of the display panel 100 is in the flat state.

In such an embodiment, when the edge area of the display panel 100 is in the flat state, a difference between a luminance of an image displayed on the first display area A1 corresponding to the central area of the display panel 100 and luminances of images displayed on the second to fifth display areas A2 to A5 corresponding to the edge areas and a difference between a color coordinate of the image displayed on the first display area A1 and color coordinates of the images displayed on the second to fifth display areas A2 to A5 may be compensated so that the display quality of the display panel 100 may be enhanced.

Figure 9:
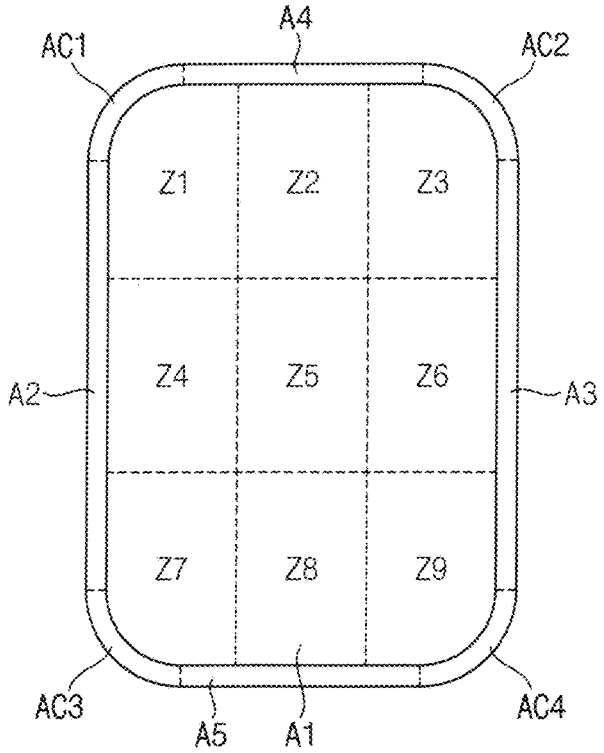
FIG. 9 is a conceptual diagram illustrating an operation of a driving controller of a display apparatus according to another alternative embodiment of the invention.

FIG. 9 is a conceptual diagram illustrating an operation of a driving controller of a display apparatus according to another alternative embodiment of the invention.

The embodiment of the display apparatus and the method of driving the display apparatus shown in FIG. 9 is substantially the same as the embodiments of the display apparatus and the method of driving the display apparatus described above referring to FIGS. 1 to 7 except that the edge areas of the display panel varying in state are disposed at an upper side, a lower side, a left side and a right side of the display panel. Thus, the same reference numerals will be used to refer to the same or like elements as those described above with reference to FIGS. 1 to 7, and any repetitive detailed description thereof will be omitted.

Referring to FIGS. 1, 3 to 6 and 9, an embodiment of the display apparatus includes a display panel 100 and a display panel driver. The display panel driver includes a driving controller 200, a gate driver 300, a gamma reference voltage generator 400 and a data driver 500.

At least one edge area of the display panel 100 may have a rounded shape in the first state and at least one edge area of the display panel 100 may have a flat shape in the second state. In one embodiment, for example, a central area of the display panel 100 may be flat in both of the first state and the second state.

In one embodiment, for example, a left edge area, a right edge area, an upper edge area and a lower edge area of the display panel 100 may be round in the first state and the left edge area, the right edge area, the upper edge area and the lower edge area of the display panel 100 may be flat in the second state. In an embodiment, for example, all of the left edge area, the right edge area, the upper edge area and the lower edge area have the rounded shape or all of the left edge area, the right edge area, the upper edge area and the lower edge area have the flat shape, but not being limited thereto. In an alternative embodiment, each of the left edge, the right edge area, the upper edge area and the lower edge area may independently have the rounded shape or the flat shape.

The display panel 100 may include a first display area A1 having a first pixel density and a second display area (e.g. A2) having a second pixel density less than the first pixel density. The second display area (e.g. A2) may correspond to the edge area of the display panel 100.

In an embodiment, the display panel 100 may include a first edge area disposed in a left side of the display panel 100, a second edge area disposed in a right side of the display panel 100, a third edge area disposed in an upper side of the display panel 100 and a fourth edge area disposed in a lower side of the display panel 100. A display area corresponding to the first edge area may be the second display area A2, a display area corresponding to the second edge area may be the third display area A3, a display area corresponding to the third edge area may be the fourth display area A4 and a display area corresponding to the fourth edge area may be the fifth display area A5. The first display area A1 may be disposed between the second display area A2, the third display area A3, the fourth display area A4 and the fifth display area A5.

In the first state, the first display area A1 may be active and the second to fifth display areas A2 to A5 may be inactive. In the second state, the first display area A1 may be active and the second to fifth display areas A2 to A5 may be active.

The driving controller may process the input image data IMG according to the first state and the second state.

The driving controller 200 may include a luminance compensator 210 for compensating a first luminance of the first display area A1 and a second luminance of the second display area A2 such that the first luminance of the first display area A1 is equal to the second luminance of the second display area A2 for an image data having a same grayscale value in the second state.

In one embodiment, for example, the luminance of the second display area A2 may be compensated based on an average luminance of areas Z1, Z4 and Z7 of FIG. 8 which are the areas of the first display area A1 adjacent to the second display area A2. In one embodiment, for example, the luminance of the third display area A3 may be compensated based on an average luminance of areas Z3, Z6 and Z9 of FIG. 8 which are the areas of the first display area A1 adjacent to the third display area A3. In one embodiment, for example, the luminance of the fourth display area A4 may be compensated based on an average luminance of areas Z1, Z2 and Z3 of FIG. 8 which are the areas of the first display area A1 adjacent to the fourth display area A4. In one embodiment, for example, the luminance of the fifth display area A5 may be compensated based on an average luminance of areas Z7, Z8 and Z9 of FIG. 8 which are the areas of the first display area A1 adjacent to the fifth display area A5.

In an embodiment, a display area corresponding to a first corner where the first edge area and the second edge area meet may be a first corner display area AC1, a display area corresponding to a second corner where the second edge area and the third edge area meet may be a second corner display area AC2, a display area corresponding to a third corner where the first edge area and the fourth edge area meet may be a third corner display area AC3 and a display area corresponding to a fourth corner where the second edge area and the fourth edge area meet may be a fourth corner display area AC4.

A luminance of the first corner display area AC1 may be compensated by interpolating a compensation value of the second display area A2 and a compensation value of the fourth display area A4. A luminance of the second corner display area AC2 may be compensated by interpolating a compensation value of the third display area A3 and a compensation value of the fourth display area A4. A luminance of the third corner display area AC3 may be compensated by interpolating a compensation value of the second display area A2 and a compensation value of the fifth display area A5. A luminance of the fourth corner display area AC4 may be compensated by interpolating a compensation value of the third display area A3 and a compensation value of the fifth display area A5.

The driving controller 200 may further include a color coordinate compensator 220 for compensating a first color coordinate of the first display area A1 and a second color coordinate of the second display area A2 such that the first color coordinate of the first display area A1 is equal to the first color coordinate of the second display area A2 for an image data having the same grayscale value in the second state. The operation of the color coordinate compensator 220 may be similar to the operation of the luminance compensator 210 described above with reference to FIG. 6.

According to an embodiment, the edge area of the display panel 100 may be selectively implemented in the round state or the flat state. The edge area of the display panel 100 includes pixels so that an image may be displayed on an entire area of the display panel 100 when the edge area of the display panel 100 has the flat state.

In such an embodiment, when the edge area of the display panel 100 in the flat state, a difference between a luminance of an image displayed on the first display area A1 corresponding to the central area of the display panel 100 and luminances of images displayed on the second to fifth display areas A2 to A5 corresponding to the edge areas and a difference between a color coordinate of the image displayed on the first display area A1 and color coordinates of the images displayed on the second to fifth display areas A2 to A5 may be compensated so that the display quality of the display panel 100 may be enhanced.

Figure 10:
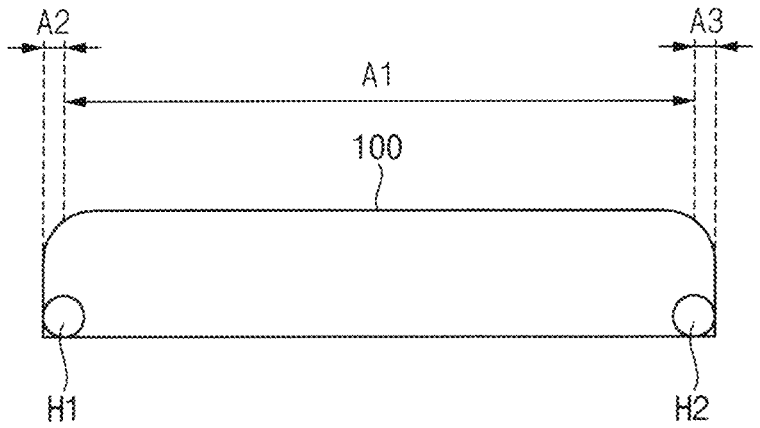
FIG. 10 is a cross-sectional view illustrating a display panel of a display apparatus in a first state according to an embodiment of the invention.
Figure 11:
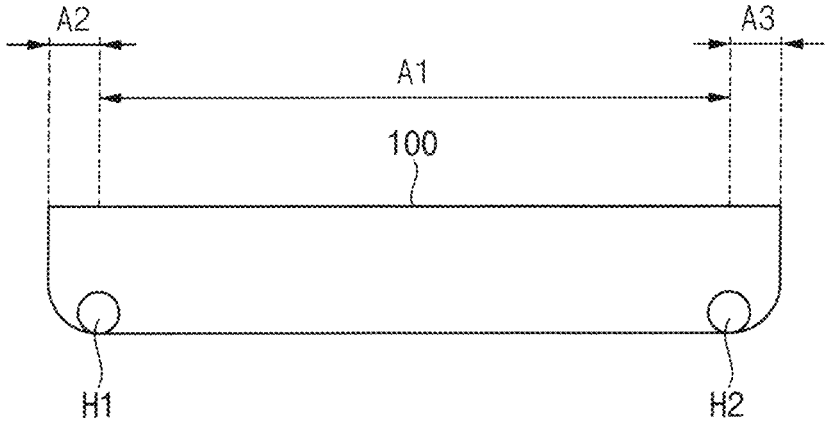
FIG. 11 is a cross-sectional view illustrating the display panel of FIG. 10 in a second state.
Figure 12:
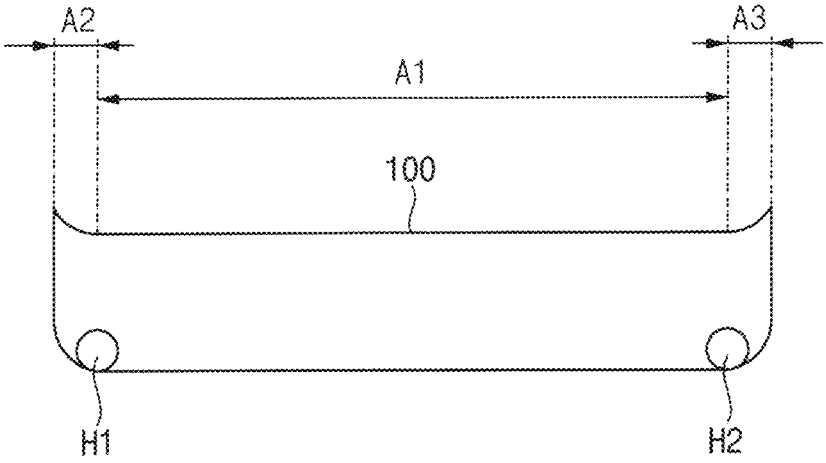
FIG. 12 is a cross-sectional view illustrating the display panel of FIG. 10 in a third state.

FIG. 10 is a cross-sectional view illustrating a display panel of a display apparatus in a first state according to an embodiment of the invention. FIG. 11 is a cross-sectional view illustrating the display panel of FIG. 10 in a second state. FIG. 12 is a cross-sectional view illustrating the display panel of FIG. 10 in a third state.

The embodiment of the display apparatus and the method of driving the display apparatus shown in FIGS. 10 to 12 is substantially the same as the embodiments of the display apparatus and the method of driving the display apparatus described above referring to FIGS. 1 to 7 except that the state of the display panel is changed to one of a first state, a second state and a third state. Thus, the same reference numerals will be used to refer to the same or like elements as those described above with reference to FIGS. 1 to 7, and any repetitive detailed description thereof will be omitted.

Referring to FIGS. 1 and 10 to 12, an embodiment of the display apparatus includes a display panel 100 and a display panel driver. The display panel driver includes a driving controller 200, a gate driver 300, a gamma reference voltage generator 400 and a data driver 500.

At least one edge area of the display panel 100 may have a rounded shape in the first state, at least one edge area of the display panel 100 may have a flat shape in the second state, and at least one edge area of the display panel 100 may have another rounded shape in the third state. In one embodiment, for example, a central area of the display panel 100 may be flat in both of the first state, the second state and the third state.

In the first state, the display surface of the display panel 100 may have a convexly rounded shape as shown in FIG. 10. In the third state, the display surface of the display panel 100 may have a concavely rounded shape as shown in FIG. 12.

In the first state, the first display area A1 may be active and the second and third display areas A2 and A3 may be inactive. In the second state, the first display area A1 may be active and the second and third display areas A2 and A3 may be active. In the third state, the first display area A1 may be active and the second and third display areas A2 and A3 may be active.

According to an embodiment, the edge area of the display panel 100 may be selectively implemented in the round state or the flat state. The edge area of the display panel 100 includes pixels so that an image may be displayed on an entire area of the display panel 100 when the edge area of the display panel 100 has the flat state.

In such an embodiment, when the edge area of the display panel 100 is the flat state, a difference between a luminance of an image displayed on the first display area A1 corresponding to the central area of the display panel 100 and luminances of images displayed on the second and third display areas A2 and A3 corresponding to the edge areas and a difference between a color coordinate of the image displayed on the first display area A1 and color coordinates of the images displayed on the second and third display areas A2 and A3 may be compensated so that the display quality of the display panel 100 may be enhanced.

Figure 13:
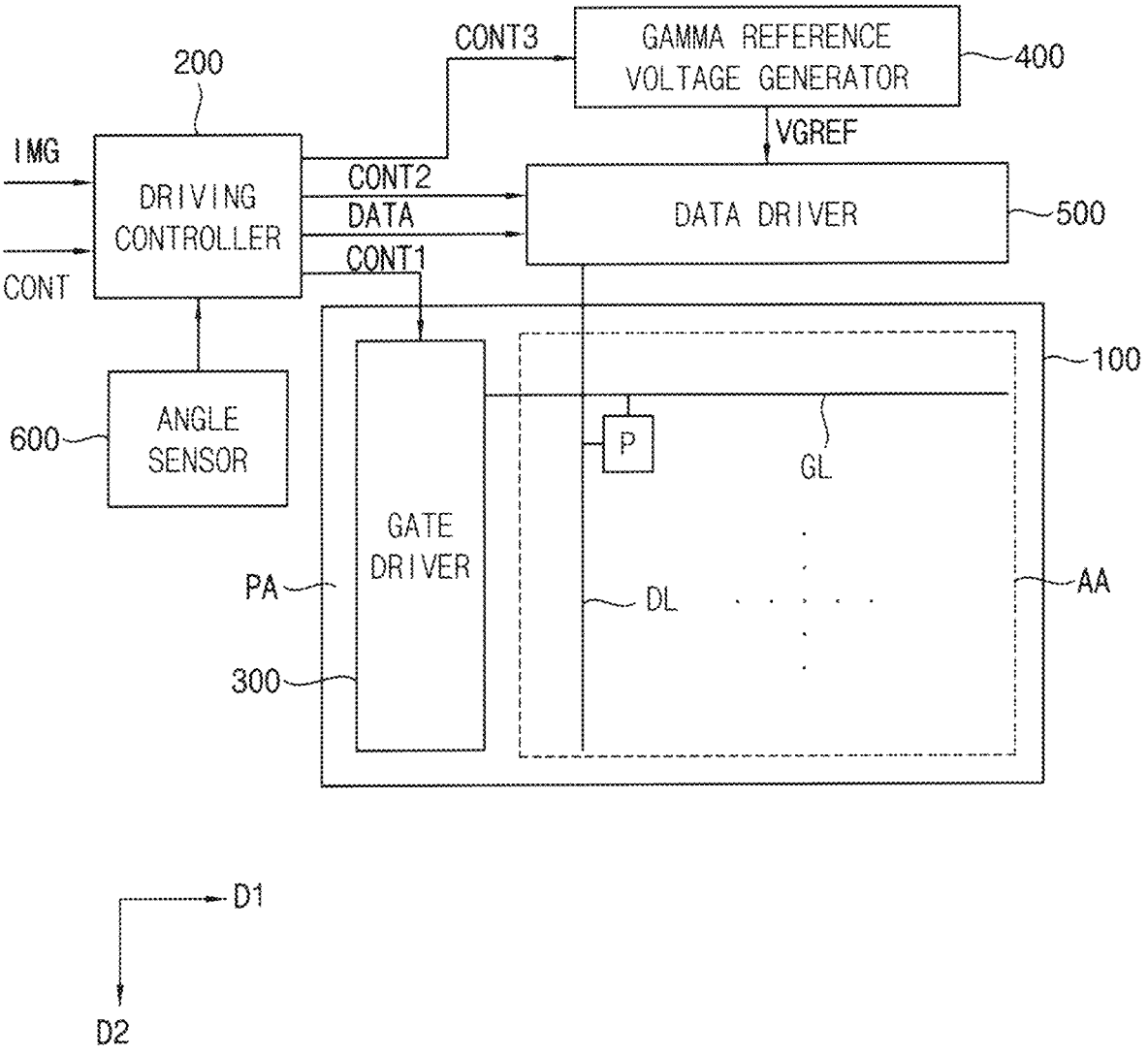
FIG. 13 is a block diagram illustrating a display apparatus according to an alternative embodiment of the invention.

FIG. 13 is a block diagram illustrating a display apparatus according to an alternative embodiment of the invention.

The embodiment of the display apparatus and the method of driving the display apparatus shown in FIG. 13 is substantially the same as the embodiments of the display apparatus and the method of driving the display apparatus described above referring to FIGS. 1 to 7 except that the display apparatus further includes an angle sensor. Thus, the same reference numerals will be used to refer to the same or like elements as those described above with reference to FIGS. 1 to 7, and any repetitive detailed description thereof will be omitted.

Referring to FIGS. 2 to 7 and 13, an embodiment of the display apparatus includes a display panel 100 and a display panel driver. The display panel driver includes a driving controller 200, a gate driver 300, a gamma reference voltage generator 400 and a data driver 500.

At least one edge area of the display panel 100 may have a rounded shape in the first state and at least one edge area of the display panel 100 may have a flat shape in the second state. In one embodiment, for example, a central area of the display panel 100 may be flat regardless of the first state and the second state.

The display apparatus may further include the angle sensor 600 for sensing an angle of the edge area. In one embodiment, for example, the angle sensor 600 may sense the angle of the edge area with respect to the flat central area of the display panel 100.

In the first state, the first display area A1 may be active and the second display area A2 and the third display area A3 may be inactive. In the second state, the first display area A1 may be active and the second display area A2 and the third display area A3 may be active.

In an embodiment, the driving controller 200 may be automatically control the active state and the inactive state of the second display area A2 and the third display area A3 based on the angle of the edge area. In such an embodiment, a method of controlling the active state and the inactive state of the second display area A2 and the third display area A3 is substantially the same as the method described above referring to FIGS. 1 to 7.

According to an embodiment, the edge area of the display panel 100 may be selectively implemented in the round state or the flat state. The edge area of the display panel 100 includes pixels so that an image may be displayed on an entire area of the display panel 100 when the edge area of the display panel 100 has the flat state.

In such an embodiment, when the edge area of the display panel 100 is the flat state, a difference between a luminance of an image displayed on the first display area A1 corresponding to the central area of the display panel 100 and luminances of images displayed on the second and third display areas A2 and A3 corresponding to the edge areas and a difference between a color coordinate of the image displayed on the first display area A1 and color coordinates of the images displayed on the second and third display areas A2 and A3 may be compensated so that the display quality of the display panel 100 may be enhanced.

According to embodiments of the display apparatus and the method of driving the display apparatus, as described herein, the edge area of the display panel may be selectively implemented in one of a round state and a flat state.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims, are intended to be included within the scope of the appended claims. The invention is defined by the following claims, with equivalents of the claims to be included therein.

What is claimed is:

1. A display apparatus comprising:

a display panel including an edge area having a rounded shape on a first surface of the display panel facing and most proximate to a user in a first state, and having a flat shape on an entirety of a second surface opposite an entirety of the first surface in the first state, and having a flat shape on the first surface of the display panel facing and most proximate to the user in a second state and having the rounded shape or a curved shape on the second surface opposite the first surface of the display panel in the second state;

a gate driver which applies a gate signal to a gate line of the display panel;

a data driver which applies a data voltage to a data line of the display panel; and a driving controller which processes input image data according to the first state and the second state, wherein the display panel includes a first display area having a first pixel density and a second display area having a second pixel density less than the first pixel density, and wherein the second display area corresponds to the edge area of the display panel.

2. The display apparatus of claim 1, further comprising:

a hinge disposed corresponding to the edge area of the display panel, wherein the hinge converts a shape of the edge area to the rounded shape or the flat shape.

3. The display apparatus of claim 1, wherein the first display area is active and the second display area is inactive in the first state.

4. The display apparatus of claim 3, wherein the first display area is active and the second display area is active in the second state.

5. The display apparatus of claim 4, wherein the driving controller in the first state generates a data signal based on the input image data corresponding to the first display area and outputs the data signal to the data driver, and wherein the driving controller in the second state upscales the input image data corresponding to the first display area to match the first display area and the second display area to generate an upscaled data signal and outputs the upscaled data signal to the data driver.

6. The display apparatus of claim 4, wherein the driving controller in the second state generates a data signal based on the input image data corresponding to the first display area and the second display area and outputs the data signal to the data driver, and wherein the driving controller in the first state trims the input image data corresponding to the first display area and the second display area to match the first display area to generate a trimmed data signal and outputs the trimmed data signal to the data driver.

7. The display apparatus of claim 4, wherein the driving controller includes a luminance compensator which compensates a first luminance of the first display area and a second luminance of the second display area in a way such that the first luminance of the first display area is equal to the second luminance of the second display area for an image data having a same grayscale value in the second state.

8. The display apparatus of claim 7, wherein the display panel includes a first edge area disposed in a left side of the display panel and a second edge area disposed in a right side of the display panel, wherein a display area corresponding to the first edge area is the second display area and a display area corresponding to the second edge area is a third display area, and the first display area is disposed between the second display area and the third display area, and wherein a luminance of the second display area is compensated based on an average luminance of an area of the first display area adjacent to the second display area, and a luminance of the third display area is compensated based on an average luminance of an area of the first display area adjacent to the third display area.

9. The display apparatus of claim 7, wherein the display panel includes a first edge area disposed in a left side of the display panel, a second edge area disposed in a right side of the display panel, a third edge area disposed in an upper side of the display panel, and a fourth edge area disposed in a lower side of the display panel, wherein a display area corresponding to the first edge area is the second display area, a display area corresponding to the second edge area is a third display area, a display area corresponding to the third edge area is a fourth display area, a display area corresponding to the fourth edge area is a fifth display area, and the first display area is disposed between the second display area, the third display area, the fourth display area and the fifth display area, and wherein a luminance of the second display area is compensated based on an average luminance of an area of the first display area adjacent to the second display area, a luminance of the third display area is compensated based on an average luminance of an area of the first display area adjacent to the third display area, a luminance of the fourth display area is compensated based on an average luminance of an area of the first display area adjacent to the fourth display area, and a luminance of the fifth display area is compensated based on an average luminance of an area of the first display area adjacent to the fifth display area.

10. The display apparatus of claim 7, wherein the display panel includes a first edge area disposed in a left side of the display panel, a second edge area disposed in a right side of the display panel, a third edge area disposed in an upper side of the display panel, and a fourth edge area disposed in a lower side of the display panel, wherein a display area corresponding to the first edge area is the second display area, a display area corresponding to the second edge area is a third display area, a display area corresponding to the third edge area is a fourth display area, a display area corresponding to the fourth edge area is a fifth display area, and the first display area is disposed between the second display area, the third display area, the fourth display area and the fifth display area, wherein a display area corresponding to a first corner where the first edge area and the second edge area meet is a first corner display area, a display area corresponding to a second corner where the second edge area and the third edge area meet is a second corner display area, a display area corresponding to a third corner where the first edge area and the fourth edge area meet is a third corner display area, and a display area corresponding to a fourth corner where the second edge area and the fourth edge area meet is a fourth corner display area, wherein a luminance of the second display area is compensated based on an average luminance of an area of the first display area adjacent to the second display area, a luminance of the third display area is compensated based on an average luminance of an area of the first display area adjacent to the third display area, a luminance of the fourth display area is compensated based on an average luminance of an area of the first display area adjacent to the fourth display area, and a luminance of the fifth display area is compensated based on an average luminance of an area of the first display area adjacent to the fifth display area, and wherein a luminance of the first corner display area is compensated by interpolating a compensation value of the second display area and a compensation value of the fourth display area, a luminance of the second corner display area is compensated by interpolating a compensation value of the third display area and the compensation value of the fourth display area, a luminance of the third corner display area is compensated by interpolating the compensation value of the second display area and a compensation value of the fifth display area, and a luminance of the fourth corner display area is compensated by interpolating the compensation value of the third display area and the compensation value of the fifth display area.

11. The display apparatus of claim 4, wherein the driving controller includes a color coordinate compensator which compensates a first color coordinate of the first display area and a second color coordinate of the second display area in a way such that the first color coordinate of the first display area is equal to the first color coordinate of the second display area for an image data having a same grayscale value in the second state.

12. The display apparatus of claim 11, wherein the display panel includes a first edge area disposed in a left side of the display panel and a second edge area disposed in a right side of the display panel, wherein a display area corresponding to the first edge area is the second display area and a display area corresponding to the second edge area is a third display area, and the first display area is disposed between the second display area and the third display area, and wherein a color coordinate of the second display area is compensated based on an average color coordinate of an area of the first display area adjacent to the second display area, and a color coordinate of the third display area is compensated based on an average color coordinate of an area of the first display area adjacent to the third display area.

13. The display apparatus of claim 4, further comprising:

an angle sensor which senses an angle of the edge area of the display panel.

14. The display apparatus of claim 13, wherein the driving controller automatically controls an active state and an inactive state of the second display area based on the angle of the edge area.

15. The display apparatus of claim 1, wherein the edge area of the display panel has another rounded shape in a third state, wherein a display surface of the display panel has a convexly rounded shape in the first state, and wherein the display surface of the display panel has a concavely rounded shape in the third state.

16. The display apparatus of claim 15, wherein the first display area is active and the second display area is inactive in the first state, wherein the first display area is active and the second display area is active in the second state, and wherein the first display area is active and the second display area is active in the third state.

17. A method of driving a display apparatus, the method comprising:

determining a state of the display apparatus, wherein the state of the display apparatus includes a first state in which an edge area of a display panel of the display apparatus has a rounded shape on a first surface of the display panel facing and most proximate to a user, and having a flat shape on an entirety of a second surface opposite an entirety of the first surface in the first state and a second state in which the edge area of the display panel has a flat shape on the first surface of the display panel facing and most proximate to the user and having the rounded shape or a curved shaped on the second surface opposite the first surface of the display panel in the second state;

processing input image data according to the first state and the second state;

applying a gate signal to a gate line of the display panel; and applying a data voltage to a data line of the display panel, wherein the display panel includes a first display area having a first pixel density and a second display area having a second pixel density less than the first pixel density, and wherein the second display area corresponds to the edge area of the display panel.

18. The method of claim 17, wherein the first display area is active and the second display area is inactive in the first state, and wherein the first display area is active and the second display area is active in the second state.

19. The method of claim 18, wherein the processing input image data comprises:

generating a data signal in the first state based on the input image data corresponding to the first display area; and generating an upscaled data signal in the second state by upscaling the input image data corresponding to the first display area to match the first display area and the second display area.

20. The method of claim 18, wherein the processing input image data comprises:

generating a data signal in the second state based on the input image data corresponding to the first display area and the second display area; and generating a trimmed data signal in the first state by trimming the input image data corresponding to the first display area and the second display area to match the first display area, and outputting the trimmed data signal to a data driver of the display apparatus in the first state.

* * * * *